United States Patent [19]

Simmonds et al.

[11] Patent Number: 4,791,788

[45] Date of Patent: Dec. 20, 1988

[54] METHOD FOR OBTAINING IMPROVED TEMPERATURE REGULATION WHEN USING LIQUID HELIUM COOLING

[75] Inventors: Michael B. Simmonds, Del Mar; Ronald E. Sager, Carlsbad, both of Calif.

[73] Assignee: Quantum Design, Inc., San Diego, Calif.

[21] Appl. No.: 87,465

[22] Filed: Aug. 24, 1987

[51] Int. Cl.[4] ..... F17C 13/02

[52] U.S. Cl. ..... 62/49; 62/55; 62/514 R

[58] Field of Search ..... 62/55, 514 R, 49

[56] References Cited

U.S. PATENT DOCUMENTS

| | | | |
|---|---|---|---|
| 3,729,946 | 5/1973 | Massey | 62/55 |
| 4,192,147 | 3/1980 | Gilbert et al. | 62/49 |
| 4,280,499 | 7/1981 | Squazzi | 62/514 R |
| 4,302,943 | 12/1981 | Niemann et al. | 62/49 |
| 4,485,640 | 12/1984 | Bon Mardion et al. | 62/514 R |
| 4,495,782 | 1/1985 | Salour et al. | 62/514 R |
| 4,607,490 | 8/1986 | Seidel et al. | 62/51 |

*Primary Examiner*—Ronald C. Capossela

*Attorney, Agent, or Firm*—Fulwider, Patton, Rieber, Lee & Utecht

[57] ABSTRACT

A method for controlling the flow of a cooling medium such as helium into an insulated chamber surrounding a region to establish a stable thermal environment in the region over a wide range of cryogenic temperatures. A thermally insulated capsule surrounds a variable temperature capillary to precondition the helium before it flows into the insulated chamber. The capillary can be operated in different modes, depending upon the heating or lack of heating of the capillary. At low temperatures the capillary can pass the helium in its liquid phase, at high temperatures only a small amount of gaseous helium is passed, and at certain intermediate temperatures there is an ample flow of gaseous helium only.

5 Claims, 1 Drawing Sheet

METHOD FOR OBTAINING IMPROVED TEMPERATURE REGULATION WHEN USING LIQUID HELIUM COOLING

FIELD OF THE INVENTION

This invention relates to a method for controlling the flow of liquid helium into a chamber so as to produce a stable thermal environment over a wide range of cryogenic temperatures.

BACKGROUND OF THE INVENTION

When designing sample measuring instruments which operate in a bath of liquid helium, it is common to provide for the cooling of the sample by drawing some of the liquid up from the bath into the region of the sample. The liquid is drawn by a pressure difference through a small diameter capillary tube into an insulated chamber in which the sample is mounted. If temperatures below approximately 4.2K are required, the chamber is evacuated to a pressure such that the liquid helium in the chamber boils at that temperature. If temperatures above 4.2K are required, a heater is used which boils the liquid and heats the vapor to the desired value. Through a combination of these techniques, a range of temperatures from about 2° K. to above room temperature may be achieved.

There are, however, several serious difficulties with this straightforward temperature control scheme. The capillary tube must be made large enough that a significant flow of helium can be obtained. This is necessary so that the sample chamber can be cooled in a reasonable time period and to provide responsive temperature control in general. This large capillary, however, makes it difficult to achieve temperatures well below 4.2° K. when pumping strongly on the liquid helium in the chamber. The reason is that the reduced vapor pressure above the bath, in addition to cooling the helium already in the chamber, also pulls more 4.2° K. liquid into the chamber at a high rate. This higher temperature helium creates a large heat load on the chamber and limits the ultimate low temperature of the instrument.

One technique which has been used to avoid this problem is to provide a mechanical valve at the inlet of the capillary tube. In this way, it is possible to use a large capillary to allow rapid cooling and to admit a quantity of liquid into the sample chamber. The valve can then be closed so that no further liquid enters the chamber while this quantity is cooled by evacuation. When the liquid in the chamber is exhausted, the process must be repeated. Unfortunately, the difficulty of making reliable cryogenic valves has limited the commercial usefulness of this approach.

A second problem occurs in the temperature region between about 5° K. and 20° K. The liquid helium which is being drawn through the capillary will be vaporized before it reaches the chamber or just as it enters the chamber. If the helium is being vaporized in the capillary, before it reaches the chamber, then increasing the amount of heat applied to the bottom of the chamber will increase the temperature of the chamber; this is the expected behavior. However, if the helium liquid is in the chamber, then increasing the power applied to the heater may actually cause the chamber to cool. This is because the heat will cause a rapid flow of freshly vaporized 4° K. gas through the chamber. Any feedback control system implemented to regulate the temperature of the chamber will respond by increasing the power to the heater, vaporizing more liquid and cooling the chamber even further. At some point, all the liquid in the chamber will be vaporized and the chamber will heat up well above the desired temperature.

The system just described is similar to a relaxation oscillator, and is caused be the presence of the two helium phases in the chamber region. Above about 20° K. the oscillations cease to be a problem due to the increased heat capacity of the chamber relative to the heat capacity of the helium gas. This has a damping effect on the system. The higher temperatures in the chamber also tend to keep the liquid-gas interface pushed down into the capillary, and less liquid is available to participate in the process.

It should be appreciated that the cryogenic valve mentioned earlier in this section would not alleviate this oscillation problem.

Finally, the presence of liquid helium or dense helium gas in contact with the sample can cause errors in certain types of measurements. Its presence also makes the insertion and removal of samples difficult when the chamber is at cryogenic temperatures.

SUMMARY OF THE INVENTION

The present invention provides a thermally insulated capsule surrounding a variable temperature capillary to pre-condition the helium before it is allowed to cool the sample. The helium is also prevented from actually entering the sample chamber by routing it through a narrow annular space around the outside of the chamber. Thermal contact is provided to the sample by maintaining a low pressure of static helium gas in the chamber.

The capillary can be operated in three distinct modes. If no heat is applied to the capillary, then large quantities of liquid can be drawn though to provide rapid cooling of the sample or to quickly fill the annular space with liquid. Let us call this Mode 1. If a relatively large amount of heat is applied to the capillary, its temperature will rise to approximately 30020 K. In this state, the volume of helium which can be passed is reduced by several hundred fold, effectively shutting it off. We shall refer to this as Mode 2. The small amount of helium which does pass in Mode 2 is cooled back to about 4° K. as it passes through the uninsulated coupling tube between the capsule and the sample region. When the capsule is in Mode 2, one may pump vigorously on the liquid already in the annular space around the sample without drawing additional warm liquid into the region.

It is also possible to thermostatically control the temperature of the capillary at about 10° K. so that the liquid is completely vaporized but the flow of cold helium gas is not unduly restricted; this is called Mode 3. Just as in Mode 2, the helium gas cools back down to the temperature of the bath, about 4.2° K., as it passes through the uninsulated coupling tube. This mode is used when operating in the 5° K. to 20° K. region to avoid the problems of relaxation oscillations caused by the presence of liquid in the sample region.

BRIEF DESCRIPTION OF THE DRAWING

For better understanding of the invention reference should be made to the accompanying drawing, wherein.

DESCRIPTION OF THE PREFERRED EMBODIMENT

Figure 1:
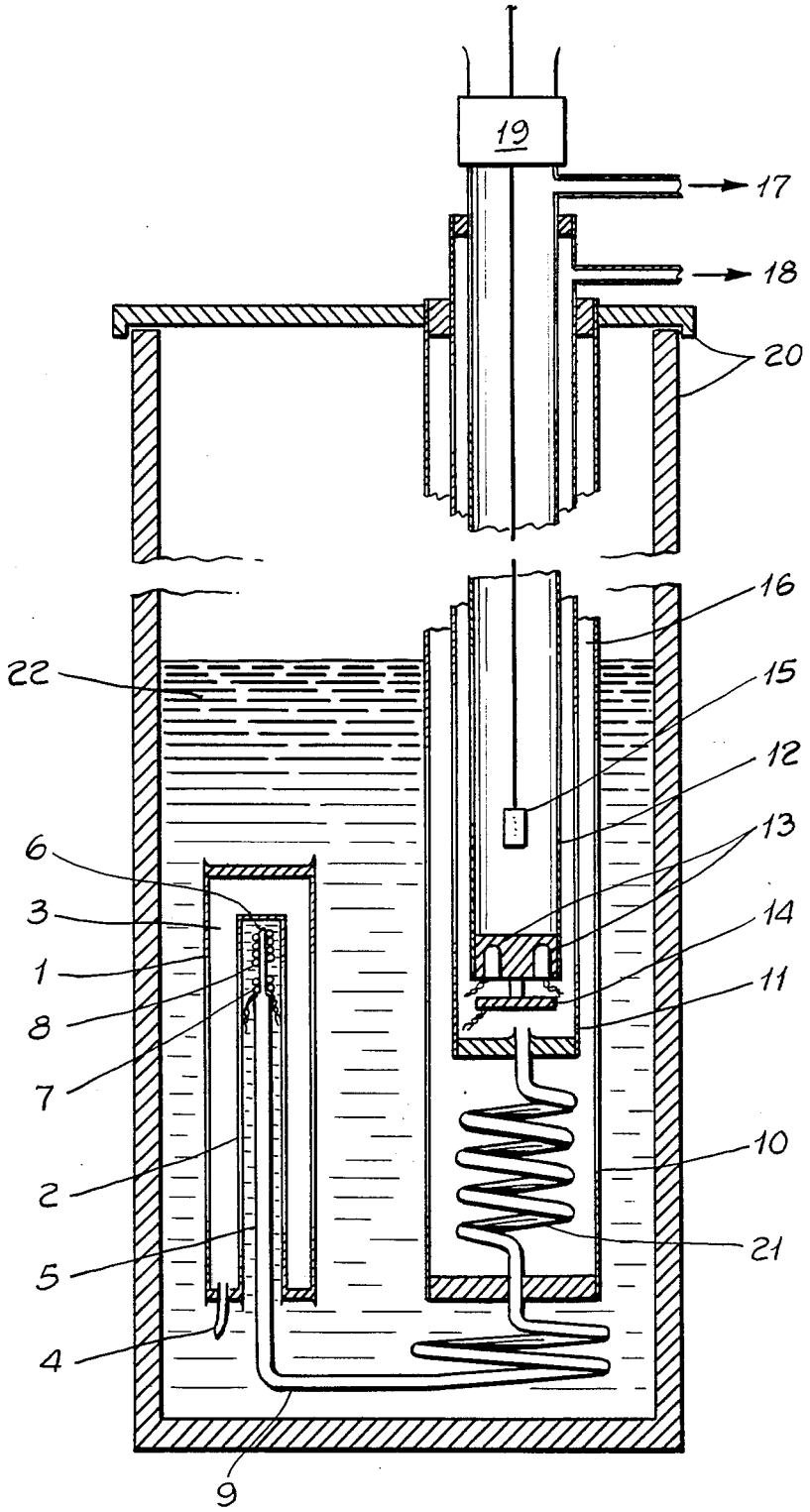
FIG. 1 is a cross-sectional view of the variable temperature capillary enclosed in an insulated capsule and of the sample chamber region.

Referring to FIG. 1, the capsule 1-4 and the lower end of the sample measuring region 10-12 are submerged in a bath of liquid helium 22 which is contained in a conventional cryogenic vessel 20.

The sample measuring region comprises a set of vacuum insulated tubes 10, 11 surrounding the sample tube itself 12. The vacuum insulating region 16 may also contain layers of aluminized mylar to provide improved thermal isolation. The sample 15 is admitted through an airlock valve 19 into the lower region of the sample tube. A low pressure of helium exchange gas is admitted through the sample pumping port 17 which keeps the sample in thermal equilibrium with the main thermometers 14.

The capsule comprises an outer tube sealed at both ends 1 and having an internal tube 2 projecting up into its center. The pump-out tube 4 is used for evacuating air from the annular region 3 and is then pinched off to seal the space. The outer surfaces of the capsule are made from materials such as brass or stainless steel. The internal tub is made from a low thermal conductivity material such as stainless steel, or cupronickel. This internal tube is typically 1 mm diameter by 10 cm long. The pump-out tube is typically made from soft copper to facilitate the pinch-off process. The resulting structure resembles a small, inverted dewar vessel with an extremely narrow neck.

An impedance assembly 5-8 is inserted into the internal tube of the capsule. This assembly comprises an extension tube 5, a capillary tube 6, a heater 8, and a thermometer 7. The extension tube and capillary are made from low thermal conductivity materials such a stainless steel or cupronickel.

The extension tube fits loosely into the capsule and has the capillary soldered into its end. The capillary is typically 0.1 mm inside diameter and 1 cm long. When a partial vacuum is created in the coupling tube 9, liquid is pulled up around the extension tube and back down into the end of capillary. With the dimensions just given, and with no current applied to the heater, approximately 3 cc/minute of liquid helium can be drawn through the capillary. This liquid can be used either to fill the annular space around the sample space region with liquid helium or to create very rapid cooling of the sample space.

The heater 8 is made from very fine resistance wire such as 0.08 mm diameter phosphor-bronze. The thermometer 7 is made from a short length of 0.08 mm diameter superconducting wire such as niobium-titanium alloy. Both wires are wound directly over, but are insulated from, the capillary tube and from each other.

When approximately 0.1 Watts of power is applied to the heater, the temperature of the capillary quickly rises to about 300° K. In this mode only about 10 standard cc/minute of helium gas can be drawn through the capillary tube. This represents a reduction of the mass flow by a factor of 200 compared with an unheated capillary. There is, thus, very little gas flowing through the coupling tube and the standoff tube 21 into the annular space around the sample tube 12. The residual gas which does not flow into the annular space has sufficient time to cool to the temperature of the helium bath while it is passing through the coils of the coupling tube. By using this scheme to reduce the heat flux into the annulus, it is possible to achieve temperatures of about 1.5° K. when pumping through the annulus port 18 on a pool of helium around the bottom of the sample tube.

Another mode of operation obtains when the thermometer 7 and heater 8 are used in conjunction with an electronic controller to maintain the temperature of the capillary at about 1° K. The sharp change in resistance of the superconducting wire at its transition temperature is used by the controller to maintain the temperature well above the boiling point of liquid helium, but not so hot that the flow of gas through the capillary is severely restricted. The slightly heated gas which flows into the coupling tube is able to cool back to the temperature of the bath before reaching the annular space. The cooling power of the gas is balanced against the heat introduced by the disk shaped heater 14 which is mounted on a thermal standoff below the sample tube 12 and the main thermometers 13. In this way a second control circuit is able to maintain the temperature of the sample tube at any desired temperature above that of the bath. Since no liquid can enter the standoff tube or annular space, the problem of temperature oscillations is avoided.

A set of microprocessors is used to coordinate all the heaters and pumps described in the above paragraphs. Programs which control these microprocessors allow the user to simply select a target temperature for the sample and wait for the system to reach equilibrium. Temperatures above 4.5° K. can be maintained indefinitely, whereas temperatures below 4.5° K. can be maintained for periods of between one and two hours until the pool of liquid in the annular space is exhausted and must be refilled.

Various modifications and changes may be made with regard to the foregoing detailed description without departing from the spirit of the invention.

I claim:

1. In a system for drawing a cooling medium from a liquid phase supply of the cooling medium for passage through a thermally insulated chamber surrounding a region to establish a stable thermal environment in the region over a range of cryogenic temperatures, an improved method for controlling the flow of the medium through the chamber comprising the steps of:

defining a first capillary in communication with the liquid phase supply;

defining a second capillary having an inner diameter larger than the inner diameter of the first capillary and an inlet extremity in communication with the first capillary, and an outlet extremity in communicating with the insulated chamber;

thermally insulating the first capillary and the inlet extremity of the second capillary; and applying heat to the first capillary to selectively adjust the temperature of the first capillary to a selected one of a plurality of temperature including a first temperature sufficient to vaporize the cooling medium as the cooling medium passes through the first capillary but not to significantly restrict the flow of the cooling medium therethrough and a second temperature sufficient to vaporize the cooling medium as the cooling medium passes through the first capillary and to significantly restrict the flow of the cooling medium therethrough.

2. The method of claim 1 including the step of immersing at least a portion of the outlet extremity of the large capillary in the liquid phase supply of the cooling medium.

3. The method of claim 1 including the step of immersing the small capillary, the large capillary, and a portion of the insulated chamber in the liquid phase supply of the cooling medium.

4. The method of claim 1 including the step of filling the region surrounded by the insulated chamber with cooling medium in its gaseous phase.

5. The method of claim 1 including the step of heating the insulated chamber to a temperature above the temperature of the liquid phase supply of the cooling medium.

* * * * *

UNITED STATES PATENT AND TRADEMARK OFFICE

CERTIFICATE OF CORRECTION

PATENT NO. : 4,791,788

DATED : December 20, 1988

INVENTOR(S) : Michael B. Simmonds and Ronald E. Sager

It is certified that error appears in the above-identified patent and that said Letters Patent is hereby corrected as shown below:

Column 2, line 42, please correct "30020 K." to --300°K.--.

Column 3, line 24, please correct "tub" to --tube--.

Column 4, line 7, please correct "1° K" to --10° K--.

Column 4, lines 50 and 51, please correct "communicating" to --communication--.

Column 5, line 7, please correct "filing" to --filling--.

Signed and Sealed this

Seventh Day of August, 1990

*Attest:*

HARRY F. MANBECK, JR.

*Attesting Officer*

*Commissioner of Patents and Trademarks*